US007548702B2

(12) United States Patent
Maruyama

(10) Patent No.: US 7,548,702 B2
(45) Date of Patent: Jun. 16, 2009

(54) IMAGE FORMING APPARATUS AND IMAGE FORMING METHOD FOR PREVENTING PAPER JAMS IN A FIXING UNIT

(75) Inventor: Shinji Maruyama, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 436 days.

(21) Appl. No.: 11/448,697

(22) Filed: Jun. 7, 2006

(65) Prior Publication Data

US 2007/0286618 A1 Dec. 13, 2007

(51) Int. Cl.
*G03G 15/00* (2006.01)

(52) U.S. Cl. ..... 399/6; 399/38; 399/49; 399/390

(58) Field of Classification Search ..... 399/6, 399/16, 38, 49, 69, 194, 322, 389, 390, 392
See application file for complete search history.

(56) References Cited

U.S. PATENT DOCUMENTS 5,737,681 A * 4/1998 Hyakutake et al. ..... 399/389 X
6,718,145 B2 * 4/2004 Ohta et al. ..... 399/16
6,965,747 B2 * 11/2005 Funamizu et al. ..... 399/194 X

FOREIGN PATENT DOCUMENTS

JP 2004-252377 9/2004

* cited by examiner

*Primary Examiner*—Sandra L Brase
(74) *Attorney, Agent, or Firm*—Turocy & Watson, LLP

(57) ABSTRACT

There is provided a technique in which a paper jam in a fixing unit can be prevented without adding a special part or the like, and without causing a damage of a pressure roller and distortion of an image due to adhesion of toner or paper powder to a peeling member. There are provided an image judgment part that judges whether an image is formed on a second surface as a back surface opposite to a first surface of a sheet on which an image is to be formed, and an image forming part that forms a specified image in the vicinity of a leading end of the first surface of the sheet in a sheet transport direction in a case where the image judgment part judges that the image is formed on the second surface.

20 Claims, 4 Drawing Sheets

IMAGE FORMING APPARATUS AND IMAGE FORMING METHOD FOR PREVENTING PAPER JAMS IN A FIXING UNIT

BACKGROUND OF THE INVENTION

1. Field of the Invention

The present invention relates to an image forming apparatus which heats and fixes a toner image onto a sheet, and particularly to a technique to prevent a paper jam in a fixing unit.

2. Description of the Related Art

Hitherto, when a sheet (so-called back side of paper) in which an image has already been printed on the back surface of the sheet opposite to the front surface on which an image is to be formed is used, there is a case where the back surface of the sheet is adhered to a pressure roller by the influence of the toner of the image printed on the back surface of the sheet and is wound therearound. There is disclosed a technique in which in order to prevent this, the image density of the back surface of a sheet is detected, and a peeling pawl is used according to the detection result to prevent the winding of the sheet around the pressure roller (JP-A-2004-252377).

However, in the related art, since the opportunity of contact between the pressure roller and the peeling pawl is increased, there can occur a problem that the pressure roller is damaged, the toner or paper powder adheres to the peeling pawl and the image is distorted, or the peeling performance is reduced by the abrasion of the peeling pawl. Besides, since a complicated mechanism is required in order to cause the peeling pawl to come in contact with or to be separated from the pressure roller, a reduction in cost of the apparatus is hindered.

SUMMARY OF THE INVENTION

An embodiment of the invention has an object to provide a technique in which a paper jam in a fixing unit can be prevented without adding a special part or the like, and without causing a damage of a pressure roller and distortion of an image due to adhesion of toner or paper powder to a peeling member.

In order to solve the problem, an image forming apparatus of the invention is characterized by including an image judgment part that judges whether an image is formed on a second surface as a back surface opposite to a first surface of a sheet on which an image is to be formed, and an image forming part that forms a specified image in the vicinity of a leading end of the first surface of the sheet in a sheet transport direction in a case where the image judgment part judges that the image is formed on the second surface.

Besides, an image forming method of the invention is characterized by including an image judgment step in which it is judged whether an image is formed on a second surface as a back surface opposite to a first surface of a sheet on which an image is to be formed, and an image forming step in which in a case where it is judged at the image judgment step that the image is formed on the second surface, a specified image is formed in the vicinity of a leading end of the first surface of the sheet in a sheet transport direction.

DESCRIPTION OF THE EMBODIMENTS

Hereinafter, embodiments of the invention will be described with reference to the drawings.

Figure 1:
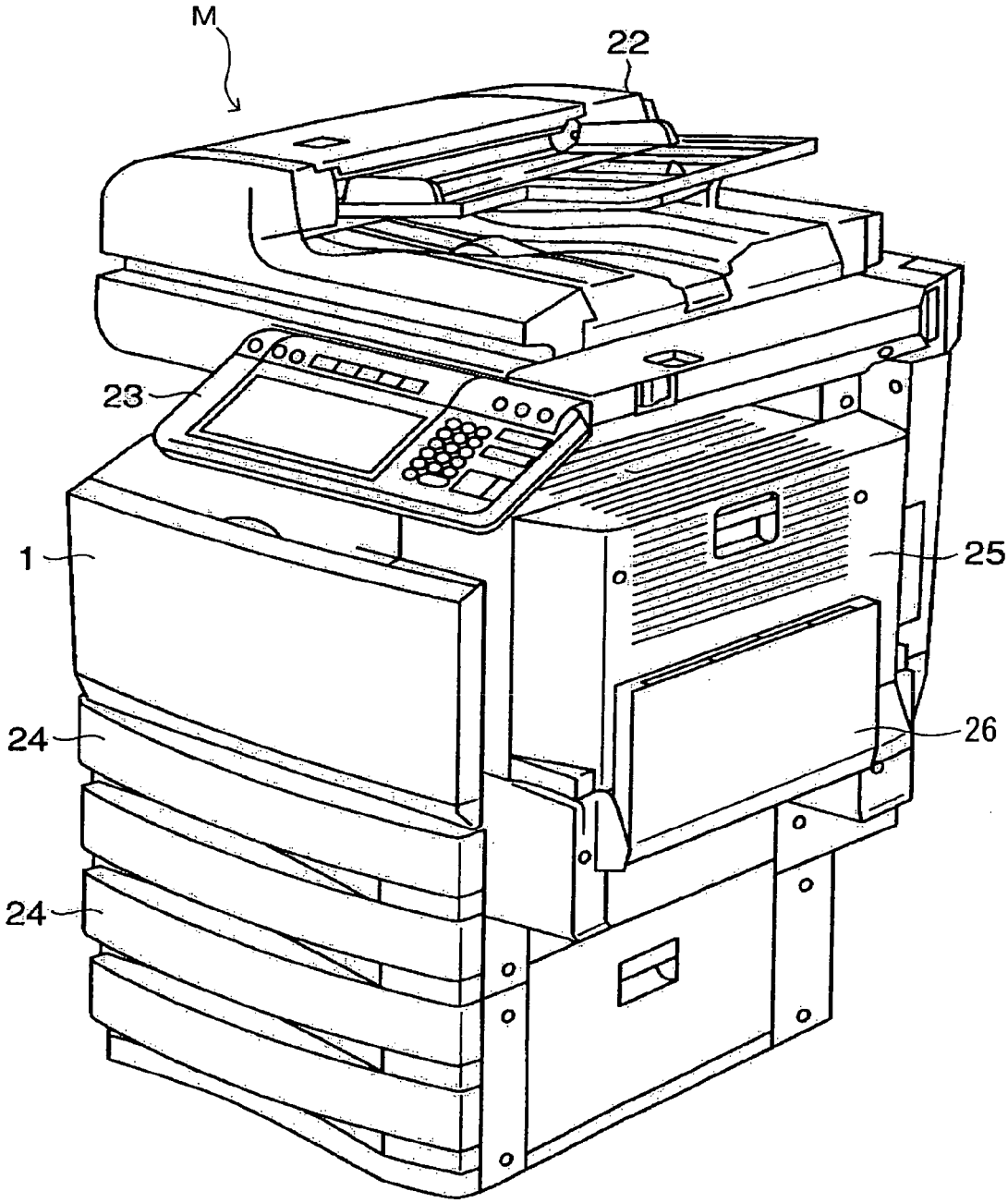
FIG. 1 is an outer appearance perspective view showing an image forming apparatus according to an embodiment.
Figure 2:
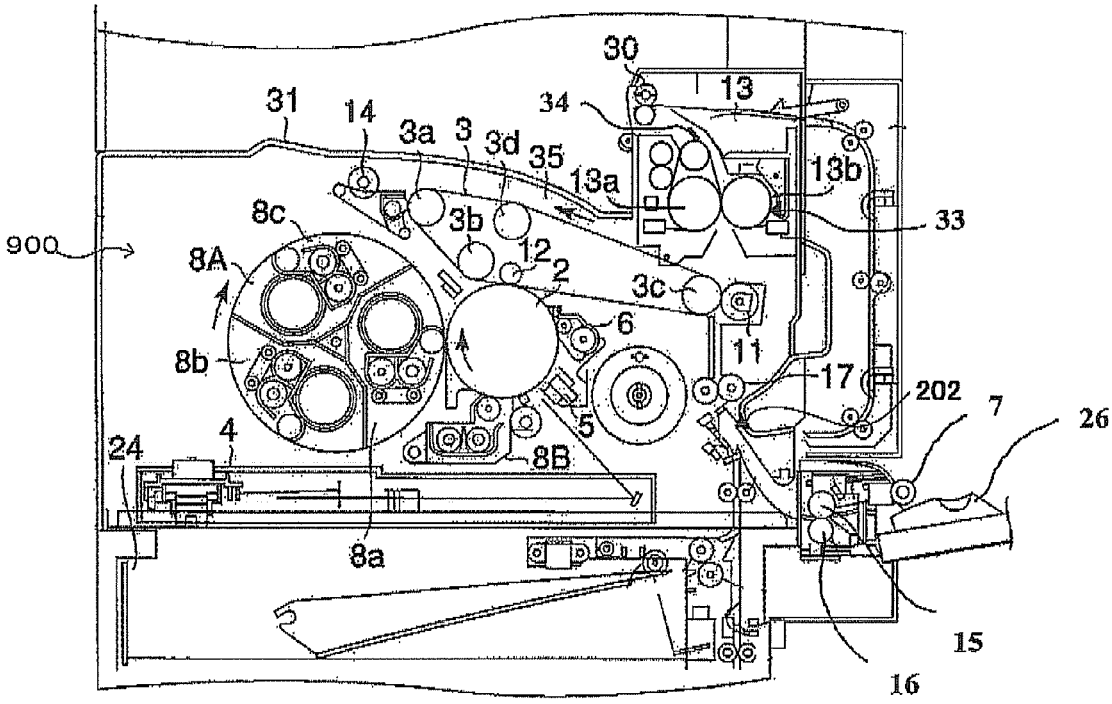
FIG. 2 is a sectional view showing an inner structure of the image forming apparatus according to the embodiment.

FIG. 1 is an outer appearance perspective view showing an image forming apparatus M according to an embodiment, and FIG. 2 is a sectional view showing an inner structure of the image forming apparatus according to the embodiment.

As shown in FIG. 1, a document transport unit 22 to transport a document to a document table is provided at an upper part of an image forming apparatus body 1, and an operation input part 23 is provided at a front upper side. Besides, plural sheet feed cassettes 24 are disposed at a front lower side of the image forming apparatus body 1, and a two-sided print unit 25 used when an image is printed on both sides of a sheet is provided at one of side parts. A manual sheet feeder 26 for feeding a long sheet, a sheet (so-called back side of paper) in which an image has already been formed on one surface, a special sheet and the like is provided at a lower part of the two-sided print unit 25.

Besides, as shown in FIG. 2, a photosensitive drum 2 as an image supporting body is provided in the image forming apparatus body 1, and a charger 5 to charge the surface of the photosensitive drum 2 to a specified potential, a monochrome developing device 8B to develop an electrostatic latent image, a color rotary developing device 8A to develop an electrostatic latent image, an intermediate transfer belt 3 as an intermediate transfer body to temporarily transfer a developer image, and a cleaner 6 to remove residual toner on the photosensitive drum 2 are respectively disposed around the photosensitive drum 2 along the rotation direction of the photosensitive drum 2.

The rotary developing device 8A includes a first developing part 8*a* for supplying yellow toner, a second developing part 8*b* for supplying cyan toner, and a third developing part 8*c* for supplying magenta toner.

An exposure device 4 as an image forming unit to form an electrostatic latent image on the photosensitive drum 2 is provided below the developing device 8B and the rotary developing device 8A.

The intermediate transfer belt 3 is wound around a first to a fourth rollers 3*a* to 3*d* by a specified tensile force, constitutes a transfer belt unit 35, and is pressed to the photosensitive drum 2 by a primary transfer roller 12. A belt cleaner 14 for cleaning the intermediate transfer belt 3 is in contact with a portion of the intermediate transfer belt 3 which is wound around the first roller 3*a*.

The manual sheet feeder 26 provided at the side lower part of the image forming apparatus body 1 includes a pickup roller 7 to take out sheets set thereon, a paper feed roller 15 and a separation roller 16 to separate the sheets taken out by the pickup roller 7 one by one and to feed it into the image forming apparatus body 1.

The sheet sent out from the manual sheet feeder 26 is transported to a register roller pair 17. The resister roller pair 17 once stops the transported sheet, corrects the inclination of the sheet with respect to the transport direction, and has a role of causing the leading end of the sheet to coincide with the leading end of the toner image on the intermediate transfer belt 3. A secondary transfer roller 11 for transferring the toner image transferred on the intermediate transfer belt 3 to the sheet is disposed at the downstream side of the register roller pair 17 in the sheet transport direction. Besides, a density detection part 202 capable of detecting the density of an image formed on a second surface as a back surface opposite to a first surface of a sheet on which a toner image is to be transferred by the secondary transfer roller 11 is provided in the vicinity of the downstream side of the register roller pair 17.

A fixing unit 13 to heat and fix the toner image transferred on the first surface of the sheet is disposed at the downstream side of the secondary transfer roller 11 in the sheet transport direction. The fixing unit 13 includes a heat roller 13*a* for heating the sheet on which the toner image is transferred, and a pressure roller 13*b* for pressing the sheet against the heat roller 13*a*. The heat roller 13*a* is provided with a peeling plate 34 to prevent the sheet from being wound around this. A temperature detection part 33 for detecting the surface temperature of the roller surface of the pressure roller 13*b* is provided in the vicinity of the roller surface of the pressure roller 13*b*.

Although the surface temperature of the pressure roller 13*b* varies according to the machine type of the image forming apparatus, as an example, the temperature becomes 120° C. at the time of Ready display (printable) from a cold start, reaches 140° C. about one minute after this, and then rises to 160° C., and becomes 170° C. during continuous printing.

A discharge roller pair 30 for discharging the sheet is provided at the downstream side of the fixing unit 13 in the sheet transport direction, and a paper discharge tray 31 to receive the sheet discharged is provided at the carrying-out side of the discharge roller pair 30.

As stated above, an image forming part 900 of the embodiment includes the photosensitive drum 2, the charger 5, the developing device 8B, the rotary developing device 8A, the intermediate transfer belt 3, the cleaner 6, the fixing unit 13 and the like, and forms the toner image on the sheet.

Figure 3:
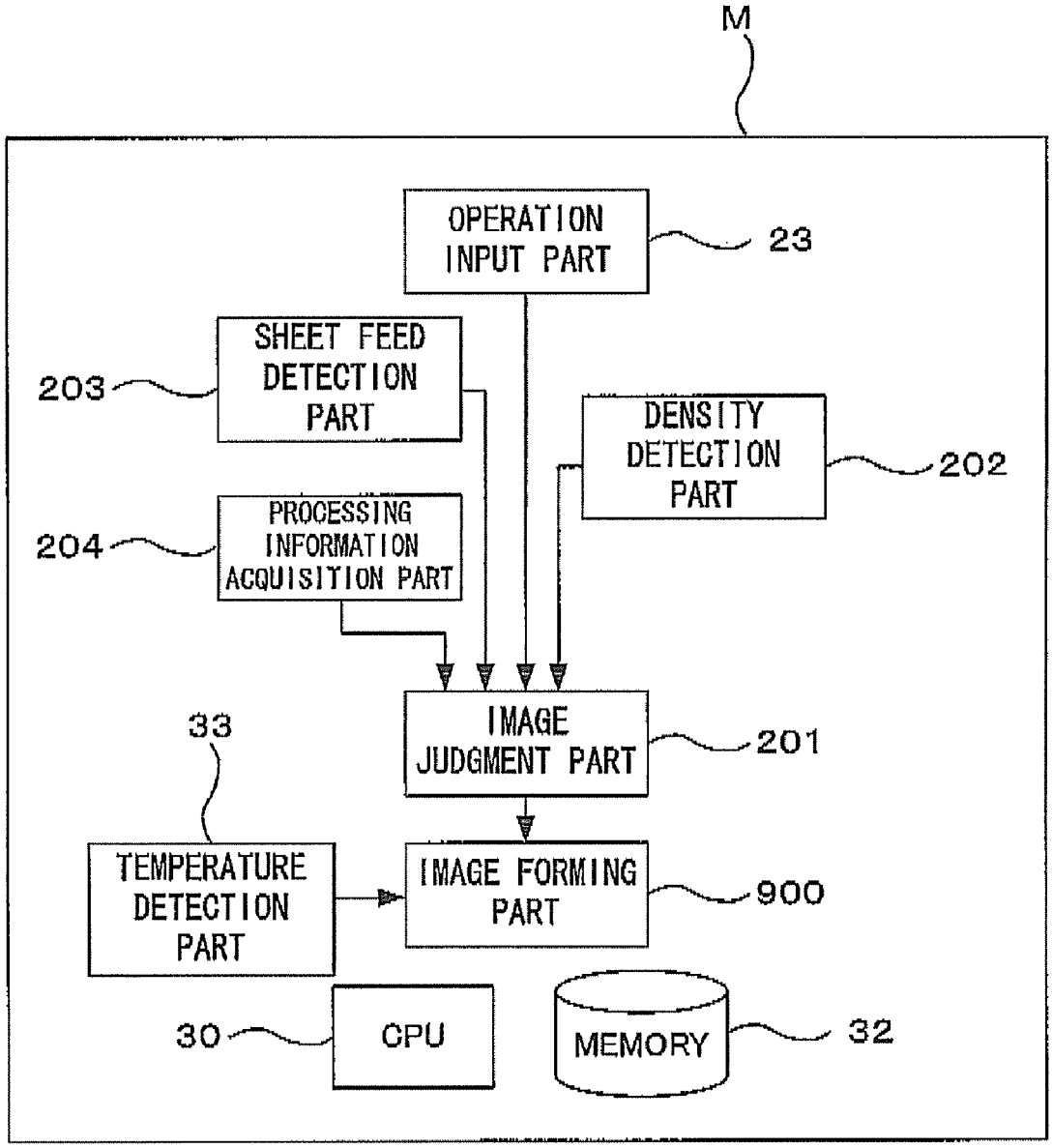
FIG. 3 is a control block diagram in the embodiment.

FIG. 3 is a function block diagram for explaining the image forming apparatus of the embodiment. The image forming apparatus M includes an image judgment part 201, the density detection part 202, a sheet feed detection part 203, the operation input part 23, a processing information acquisition part 204, the temperature detection part 33, the image forming part 900, a CPU 30 and a MEMORY 32.

The density detection part 202 is constructed of, for example, a line sensor or the like. The density detection part 202 detects the image density of the back side (second surface) opposite to the surface (first surface) on which an image is not printed. Specifically, the density detection part 202 detects the density of the image based on "print ratio to area" of a specified range from the sheet transport direction leading end (sheet transport direction downstream side end) of the second surface of the sheet or "reflection density" in the specified range.

Incidentally, the "specified range from the sheet transport direction leading end" here is a range which can have an influence on the winding around the pressure roller 13*b* in the case where a toner image is formed on the sheet, and is, for example, a range from the sheet transport direction leading end to a position spaced therefrom by about 20 mm over the whole length of the sheet in the width direction. Incidentally, the range in which the density value is sensed by the density detection part 202 can be regulated based on, for example, an elapsed time since the leading end of the transported sheet passed through the detection position of the density detection part 202.

The sheet feed detection part 203 detects the paper feeding of the sheet from the manual sheet feeder 26. Although the detection of the paper feeding can be grasped based on, for example, the paper feeding instruction from the CPU 30, a sensor is provided at the carrying-in position to the transport path of the sheet of the manual sheet feeder 26, and the paper feeding of the sheet from the manual sheet feeder 26 can also be detected.

The operation input part 23 is constructed of, for example, a touch panel display or the like, and acquires the operation input of information relating to the presence/absence of formation of an image on the second surface of the sheet, and information relating to the image formation processing to the second surface of the sheet (for example, data of the image formed on the second surface of the sheet, information indicating that the sheet is double side printed, and the like).

The image judgment part 201 judges whether the image has already been formed on the second surface of the sheet.

Specifically, in the case where the image density detected by the density detection part 202 exceeds a specified density threshold (for example, the reflection density is an OD value of 1.0 or more), the image judgment part 201 judges that the image is formed on the second surface of the sheet.

In the case where the sheet feed detection part 203 detects that the sheet is fed from the manual sheet feeder 26, the image judgment part 201 can also judge that the image is formed on the second surface of the sheet. In general, in the case where a sheet is fed from the manual sheet feeder 26 and the image formation processing is performed, especially in the case where the image formation processing is f or a normal sheet size such as A4 size, the sheet is often the back side of paper. Thus, in this embodiment, as one measure to judge whether the image is formed on the second surface of the sheet, it is also possible to use the information as to whether the paper is fed from the manual sheet feeder.

Besides, in the case where the operation input part 23 receives the operation input indicating that an image is formed on the second surface of the sheet, the image judgment part 201 can judge that the image is formed on the second surface of the sheet. Besides, in the case where the processing information acquisition part 204 acquires the information indicating that an image is formed on the second surface of the sheet, the image judgment part 201 can judge that the image is formed on the second surface of the sheet.

In the case where the image judgment part 201 judges that the image is formed on the second surface of the sheet, the image forming part 900 forms a specified image in the vicinity of the leading end of the first surface of the sheet in the sheet transport direction. Specifically, the image forming part 900 forms the specified image in a range of about 20 mm from the downstream side end of the first surface of the sheet in the sheet transform direction. The "specified image" here can be made, for example, a band-like image in which the foregoing whole specified area is made an image without spaces.

Incidentally, the operation input part 23 can also receive the operation input of information relating to the color of the sheet, and the image forming part 900 specifies the color of the sheet based on the information relating to the color of the sheet (for example, the information to specify the color of a color paper) inputted by the operation input part 23, and forms the specified image by a color in which at least one of a luminance difference, a hue contrast and a saturation contrast relative to the color of the sheet is small (that is, a color unnoticeable relative to the color of the sheet). Specifically, as the color used for the print of the specified image, for example, yellow can be named relative to the white sheet.

The image forming part 900 forms the specified image only in the case where the temperature detected by the temperature detection part 33 is lower than a specified temperature threshold. The "specified temperature threshold" here is set to, for example, such a temperature that adhesion of the sheet occurs when the temperature of the surface of the pressure roller is lower than that (for example, 140° C. when the temperature of the heat roller at the time of the fixing processing is 180° C.).

Besides, as the density of the sheet detected by the density detection part 202 becomes high, the image forming part 900 raises the density of the specified image formed on the first surface of the sheet. For example, in the case where the image density of the leading end of the back surface has an OD value of 1.0 to 1.4 in a solid black, the image forming part 900 causes the density of the specified image formed on the first surface to have an OD value of 1.0 or more in a solid black.

The CPU 30 has a role of performing various processings in the image forming apparatus, and also has a role of realizing various functions by executing programs stored in the MEMORY 32.

The MEMORY 32 is constructed of, for example, a ROM, a RAM or the like, and has a role of storing various information and programs used in the image forming apparatus.

According to the structure as stated above, since a peeling member at the pressure roller side becomes unnecessary, the winding of a sheet around the pressure roller can be prevented without causing the damage of the pressure roller due to the peeling member or the disturbance of an image due to the adhesion of toner or paper powder to the peeling member.

Figure 4:
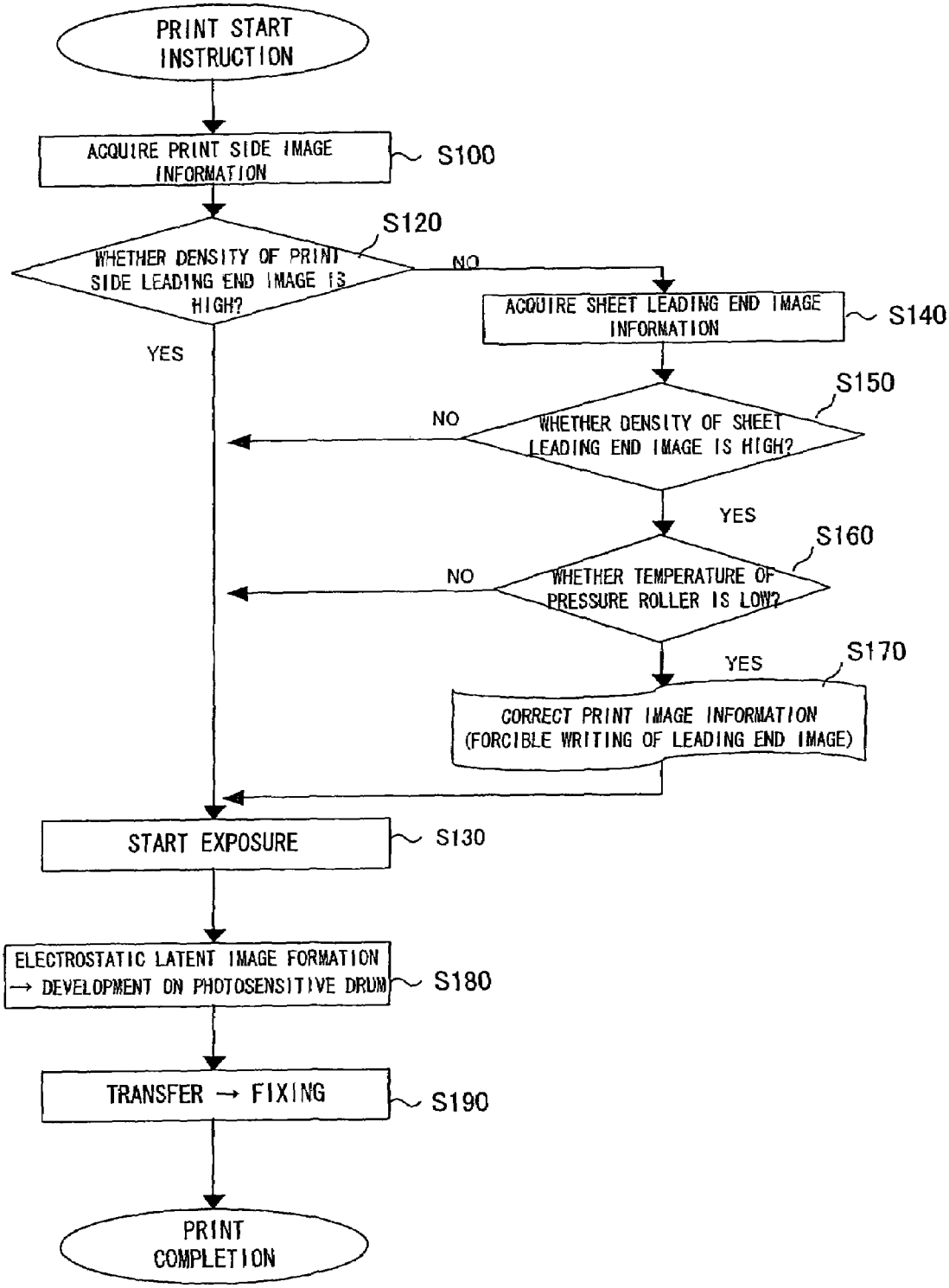
FIG. 4 is a flowchart of a print operation in the embodiment.

FIG. 4 is a flowchart for explaining a flow of processing (image forming method) in the image forming apparatus of the embodiment. Here, the processing in the case where the sheet is fed from the manual sheet feeder 26 is taken as an example.

First, a document is set on the document transport unit 22, and a copy button of the operation input part 23 is depressed. By this, the document is transported to the document table, and is optically read by a not-shown image read device (S100). At this time, the surface of the photosensitive drum 2 is uniformly charged by the charger 5, and in the manual sheet feeder 26, the pickup roller 7 takes out the set sheet.

Next, based on the read data, it is judged whether the image density printed in a range of 20 mm from the leading end of the image print surface has an OD value of 1.0 or more (S120). In the case of the OD value of 1.0 or more, a judgment of YES is made, and exposure is started (S130).

On the other hand, at S120, in the case of the OD value of less than 1.0, a judgment of No is made, the density detection part 202 detects the reflection density of the back surface leading end of the image print surface of the sheet taken out by the pickup roller 7 (S140), and it is judged whether the detected reflection density has an OD value of 1.0 or more (image judgment step) (S150). In the case of the OD value of less than 1.0, a judgment of No is made, and advance is made to step 130. In the case of the OD value of 1.0 or more, a judgment of Yes is made, and it is judged whether the surface temperature of the pressure roller 13*b* detected by the temperature detection part 33 is lower than the fixing temperature of the toner by 40° C. or more (S160).

That is, for example, in the case of the machine type in which the fixing temperature of toner is 180° C., it is judged whether the surface temperature of the pressure roller 13*b* is 140° C. or lower. In the case where the difference between the surface temperature of the pressure roller 13*b* and the fixing temperature is less than 40° C., a judgment of No is made, and advance is made to S130. On the other hand, in the case where the difference between the surface temperature of the pressure roller 13*b* and the fixing temperature is 40° C. or more, a judgment of Yes is made, the information indicating that a specified image is to be formed on the first surface of the sheet, together with the information of the color and image density of the image to be formed, is sent (S170), and advance is made to S130.

The color of the image specified at S170 is a color in which at least one of the luminance difference, hue contrast, and saturation contrast relative to the color of the sheet is small and is a color unnoticeable relative to the sheet. For example, in the case of a white sheet, yellow toner is selected. Besides, the image density is adjusted according to the reflection density detected by the density detection part 202.

In the case where the judgment of Yes is made at S120, or the judgment of No is made at S150 or 160, in the processing at S130, the exposure device 4 irradiates light corresponding to the information read by the read device 38 onto the charged photosensitive drum 2 and an electrostatic latent image is formed.

On the other hand, in the case where the judgment of No is made at S120 and the judgment of Yes is made at S150 and 160, the information indicating that an image is to be formed on the image print surface leading end portion added at S170, together with the information of the color and density of the image, is sent to S130, and a processing of forming an electrostatic latent image, together with the information of the image read by the image read device, is performed.

The electrostatic latent image formed on the photosensitive drum 2 is sent to the developing device 8B and the rotary developing device 8A by the rotation of the photosensitive drum 2, black toner is supplied from the developing device 8B, respective toners of cyan, magenta and yellow are supplied from the rotary developing device 8A, and the development is performed (S180). The developed toner image is sent onto the intermediate transfer belt 3 by the rotation of the photosensitive drum 2 and is primarily transferred by the primary transfer roller 12, and after the transfer, the photosensitive drum 2 is optically electricity-removed by a not-shown charge remover, and the toner remaining on the photosensitive drum 2 is cleaned by the cleaner 6.

In the manual sheet feeder 26, the sheet is fed into the image forming apparatus body 1 by the paper feed roller 15 and the separation roller 16, and is sent to between the intermediate transfer belt 3 and the secondary transfer roller 11. The toner image on the intermediate transfer belt 3 is secondarily transferred to this sheet. After this transfer, the sheet is peeled off from the intermediate transfer belt 3 and is sent to the fixing unit 13, and the toner image is heated by the fixing unit 13 and is pressurized and fixed (image forming step) (S190).

The respective steps in the processing of the image forming apparatus 1 are realized by causing the CPU 30 to execute the image formation program stored in the MEMORY 32.

In this embodiment, although the description has been made while using the case where the function to carry out the invention is previously recorded in the inside of the apparatus, the invention is not limited to this, and the same function may be downloaded from the network to the apparatus, or a recording medium storing the same function may be installed in the apparatus. As the recording medium, any form may be used as long as a program can be stored and the apparatus can read, such as a CD-ROM. Besides, the function previously obtained by installation or download may be such that the function is realized in cooperation with the OS (Operating System) or the like in the inside of the apparatus.

Although the invention has been described in detail with the specific mode, it would be apparent for one skilled in the art that various modifications and improvements can be made without departing from the spirit and scope of the invention.

As described above in detail, according to the invention, it is possible to provide the technique in which the sheet jam in the fixing unit can be prevented without adding a special part, and without causing the damage of the pressure roller and the disturbance of the image due to the adhesion of toner or paper powder to the peeling member.

What is claimed is:

1. An image forming apparatus comprising:

an image judgment part that judges whether an image is formed on a second surface as a back surface opposite to a first surface of a sheet on which an image is to be formed; and an image forming part that forms a specified image in a vicinity of a leading end of the first surface of the sheet in a sheet transport direction in a case where the image judgment part judges that the image is formed on the second surface.

2. The image forming apparatus according to claim 1, further comprising a density detection part that detects density of an image printed in a specified range from a sheet transport direction leading end of the second surface of the sheet when the image is formed on the first surface, wherein the image judgment part judges that the image is formed on the second surface of the sheet in a case where the image density detected by the density detection part exceeds a specified density threshold.

3. The image forming apparatus according to claim 2, wherein the density detection part detects the density of the image based on a print ratio to an area of the specified range from the sheet transport direction leading end of the second surface of the sheet when the image is formed on the first surface.

4. The image forming apparatus according to claim 2, wherein the density detection part detects the density of the image based on a reflection density in the specified range from the sheet transport direction leading end of the second surface of the sheet when the image is formed on the first surface.

5. The image forming apparatus according to claim 2, wherein as the density of the sheet detected by the density detection part becomes high, the image forming part raises the density of the specified image formed on the first surface of the sheet.

6. The image forming apparatus according to claim 1, further comprising a sheet feed detection part that detects feeding of a sheet from a manual sheet feeder, wherein the image judgment part judges that the image is formed on the second surface of the sheet in a case where the sheet feed detection part detects that the sheet is fed from the manual sheet feeder.

7. The image forming apparatus according to claim 1, further comprising an operation input part that receives an operation input of information relating to presence/absence of formation of the image on the second surface of the sheet, wherein the image judgment part judges that the image is formed on the second surface of the sheet in a case where the operation input part receives the operation input indicating that the image is formed on the second surface of the sheet.

8. The image forming apparatus according to claim 1, further comprising a processing information acquisition part that acquires information relating to an image forming processing to the second surface of the sheet, wherein the image judgment part judges that the image is formed on the second surface of the sheet in a case where the processing information acquisition part acquires the information indicating that the image is formed on the second surface of the sheet.

9. The image forming apparatus according to claim 1, wherein the image forming part forms a toner image on the sheet, there is provided a temperature detection part that detects temperature of a pressure roller to press the sheet against a heat roller when the toner image is heated and fixed to the sheet, and the image forming part forms the specified image only in a case where the temperature detected by the temperature detection part is lower than a specified temperature threshold.

10. The image forming apparatus according to claim 1, wherein the image forming part forms the specified image in a specified area in the vicinity of the leading end of the first surface of the sheet in the sheet transport direction in a case where the image judgment part judges that the image is formed on the second surface.

11. The image forming apparatus according to claim 1, wherein the image forming part forms the specified image by a color in which at least one of a luminance difference, a hue contrast and a saturation contrast relative to a color of the sheet is small.

12. The image forming apparatus according to claim 11, further comprising an operation input part that receives an operation input of information relating to the color of the sheet, wherein the image forming part specifies the color of the sheet based on the information received by the operation input part.

13. An image forming apparatus comprising:

image judgment means for judging whether an image is formed on a second surface as a back surface opposite to a first surface of a sheet on which an image is to be formed; and image forming means for forming a specified image in a vicinity of a leading end of the first surface of the sheet in a sheet transport direction in a case where the image judgment means judges that the image is formed on the second surface.

14. The image forming apparatus according to claim 13, further comprising density detection means for detecting density of an image printed in a specified range from a sheet transport direction leading end of the second surface of the sheet when the image is formed on the first surface, wherein the image judgment means judges that the image is formed on the second surface of the sheet in a case where the image density detected by the density detection means exceeds a specified density threshold.

15. The image forming apparatus according to claim 13, further comprising sheet feed detection means for detecting feeding of a sheet from a manual sheet feeder, wherein the image judgment means judges that the image is formed on the second surface of the sheet in a case where the sheet feed detection means detects that the sheet is fed from the manual sheet feeder.

16. The image forming apparatus according to claim 13, further comprising operation input means for receiving an operation input of information relating to presence/absence of formation of the image on the second surface of the sheet, wherein the image judgment means judges that the image is formed on the second surface of the sheet in a case where the operation input means receives the operation input indicating that the image is formed on the second surface of the sheet.

17. The image forming apparatus according to claim 13, further comprising processing information acquisition means for acquiring information relating to an image forming processing to the second surface of the sheet, wherein the image judgment means judges that the image is formed on the second surface of the sheet in a case where the processing information acquisition means acquires the information indicating that the image is formed on the second surface of the sheet.

18. The image forming apparatus according to claim 13, wherein the image forming means forms a toner image on the sheet, there is provided temperature detection means for detecting temperature of a pressure roller to press the sheet against a heat roller when the toner image is heated and fixed to the sheet, and the image forming means forms the specified image only in a case where the temperature detected by the temperature detection means is lower than a specified temperature threshold.

19. The image forming apparatus according to claim 13, wherein the image forming means forms the specified image in a specified area in the vicinity of the leading end of the first surface of the sheet in the sheet transport direction in a case where the image judgment means judges that the image is formed on the second surface.

20. An image forming method comprising:

an image judgment step in which it is judged whether an image is formed on a second surface as a back surface opposite to a first surface of a sheet on which an image is to be formed; and an image forming step in which in a case where it is judged that the image is formed on the second surface at the image judgment step, a specified image is formed in a vicinity of a leading end of the first surface of the sheet in a sheet transport direction.

* * * * *